US005735527A

United States Patent [19]

Yiu

[11] Patent Number: 5,735,527

[45] Date of Patent: Apr. 7, 1998

[54] DART BOARD HAVING A DART SUPPORT

[76] Inventor: Chih-Hao Yiu, 7F-1, No. 30, Lin Sen Road, Taichung, Taiwan

[21] Appl. No.: 742,471

[22] Filed: Nov. 1, 1996

[51] Int. Cl.[6] ..... F41J 3/00

[52] U.S. Cl. ..... 273/408; 273/376

[58] Field of Search ..... 273/376, 408, 273/403, 378, 348.5, 348

[56] References Cited

U.S. PATENT DOCUMENTS

| | | | |
|---|---|---|---|
| 2,179,471 | 11/1939 | Lee | 273/403 |
| 3,300,216 | 1/1967 | Haecker | 273/408 |
| 3,309,091 | 3/1967 | Haecker | 273/408 |
| 4,635,940 | 1/1987 | Kelley | 273/376 |
| 5,054,792 | 10/1991 | Danielson | 273/408 |
| 5,193,817 | 3/1993 | Pan | 273/376 |
| 5,197,743 | 3/1993 | Hanson, Jr. | 273/378 |
| 5,531,450 | 7/1996 | Lu et al. | 273/348.5 |
| 5,560,617 | 10/1996 | Liang | 273/376 |

*Primary Examiner*—Mark S. Graham
*Attorney, Agent, or Firm*—Charles E. Baxley, Esq.

[57] ABSTRACT

A dart board includes a front and lower portion having one or more inclined apertures for stably receiving and supporting darts. The inclined apertures are each defined by a cone shaped wall member. The cone shaped wall member includes a free end portion of reduced diameter and having one or more slits for forming a number of resilient blades so as to resiliently engage with the dart and so as to stably retain the dart in place. A drawer is slidably engaged in the dart board for receiving elements.

2 Claims, 4 Drawing Sheets

DART BOARD HAVING A DART SUPPORT

BACKGROUND OF THE INVENTION

1. Field of the Invention

The present invention relates to a dart board, and more particularly to a dart board having a dart support.

2. Description of the Prior Art

Typical dart boards or dart games comprise a scoring area having a number of target segments to be shot by a dart and each representing a score. Normally, three darts are provided for each of the dart boards. However, none of the dart boards provide a support configuration for receiving and for supporting the darts. An additional bag or package is required for packaging the darts.

The present invention has arisen to mitigate and/or obviate the afore-described disadvantages of the conventional dart boards.

SUMMARY OF THE INVENTION

The primary objective of the present invention is to provide a dart board which includes a configuration for supporting the darts.

In accordance with one aspect of the invention, there is provided a dart board comprising a dart board body including a front and lower portion having at least one aperture formed therein for stably receiving and supporting a dart therein.

One or more sleeves are engaged in the apertures for stably receiving and supporting the dart. The sleeves each includes an upper end having a peripheral flange for engaging with the dart board body and includes a bottom end having at least one slit formed therein so as to form at least two resilient blades for resiliently engaging with the dart and for stably retaining the dart in place.

The dart board body includes a drawer slidably engaged therein for receiving elements therein.

The aperture is inclined and defined by a cone shaped wall member. The cone shaped wall member includes a free end portion of reduced diameter and having at least one slit formed therein so as to form at least two resilient blades for resiliently engaging with the dart and for stably retaining the dart in place.

At least one stop is engaged in the dart board body for stably receiving and supporting the dart.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
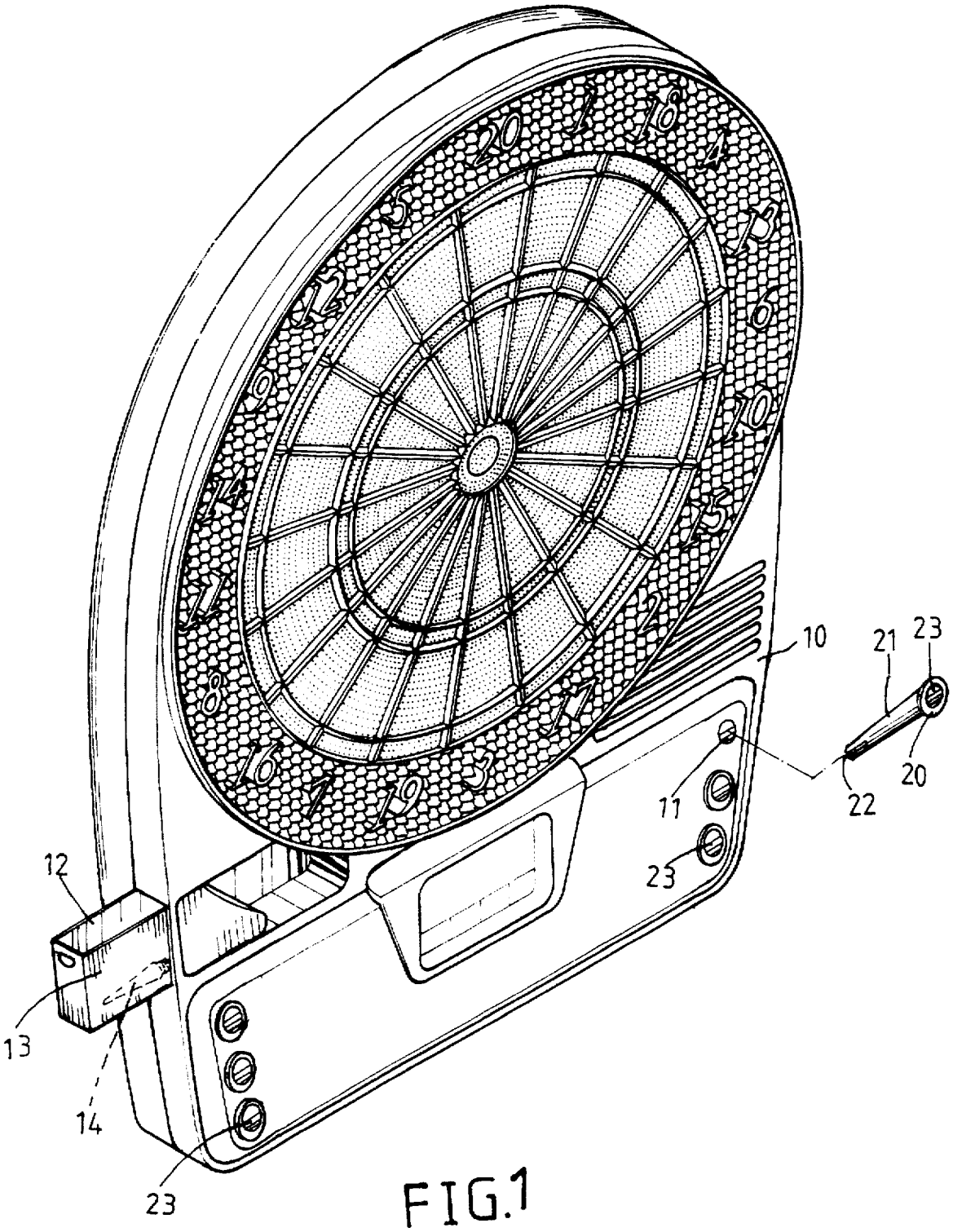
FIG. 1 is a perspective view of a dart board in accordance with the present invention.
Figure 2:
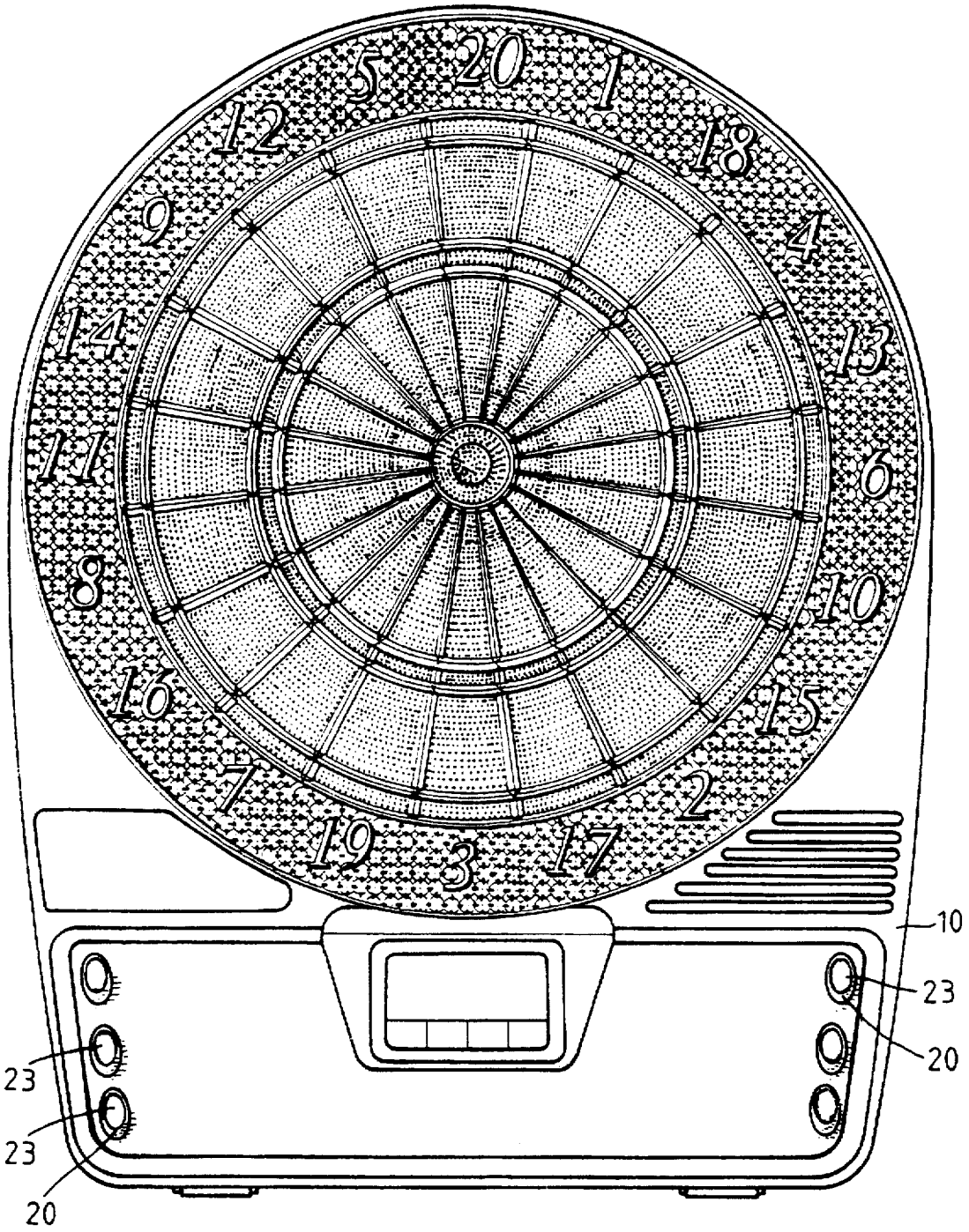
FIG. 2 is a front view of the dart board.
Figure 4:
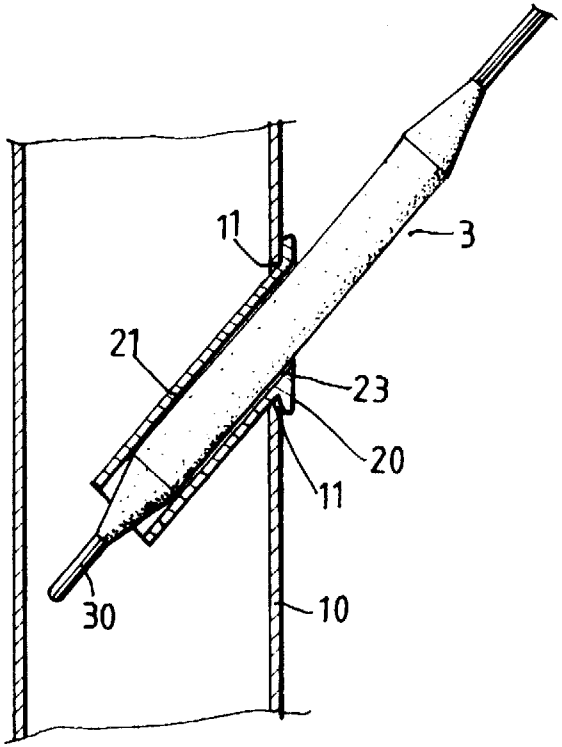
FIGS. 3 and 4 are cross sectional views illustrating the operation of the dart board.
Figure 3:
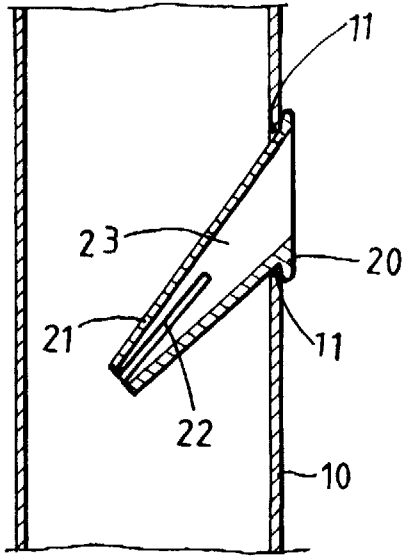

Referring to FIGS. 1 and 2, a dart board in accordance with the present invention comprises a body 10 including a front and lower portion having a number of apertures 11 formed therein for receiving and for supporting the darts 3 (FIG. 4). The body 10 includes a drawer 12 slidably engaged therein and having a room 13 for receiving the dart tip 14, for example. A number of sleeves 21 are engaged in the apertures 11 and each includes an upper peripheral flange 26 for engaging with the body 10. The peripheral flange 20 may be simply engaged in the apertures 11 and/or may he secured to the body 10 by adhesive materials or by welding process. The attachment of the sleeve 21 to the body 10 is not limited to specific manner.

It is preferable that the sleeves 21 are inclined and cone shaped having a bore 23 for stably receiving and supporting the dart 3 therein. The cone shaped sleeves 21 each includes a bottom free end portion of reduced diameter and having one or more slits 22 formed therein so as to form a number of resilient blades which may resiliently engaging with the dart 3 so as to stably retain the dart 3 in place. The dart tip 30 of the dart 3 is received in and protected by the dart board body 16 such that the dart tip 30 will not be hurt.

Figure 5:
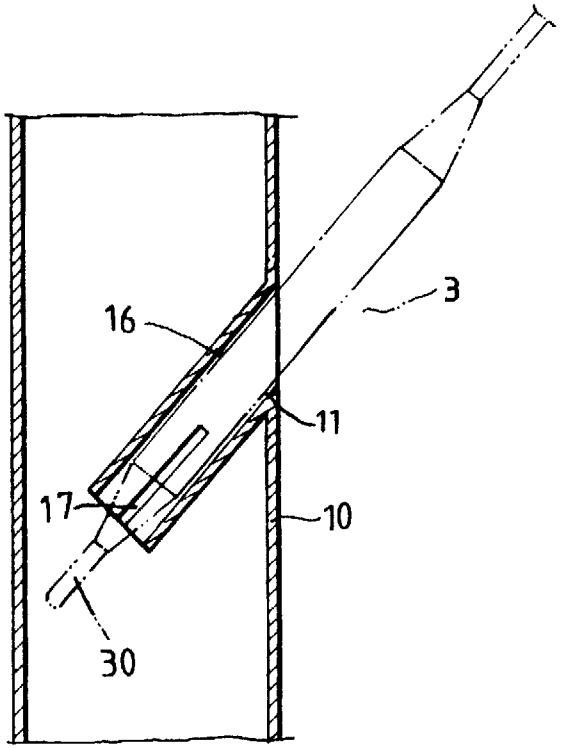

Alternatively, as shown in FIG. 5, the apertures 11 may each be defined by an inclined and cone shaped wall member 16 for stably receiving and supporting the dart 3 therein. The cone shaped wall member 16 includes a free end portion of reduced diameter and having one or more slits 17 formed therein so as to form a number of resilient blades which may resiliently engaging with the dart 3 so as to stably retain the dart 3 in place. The dart tip 30 of the dart 3 is received in and protected by the dart board body 10 such that the dart tip 30 will not be hurt.

Figure 6:
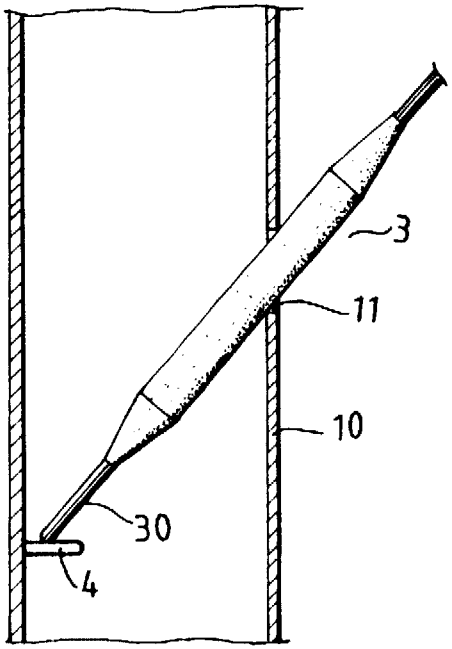
FIGS. 5 and 6 are cross sectional views illustrating two further application of the dart board.

As shown in FIG. 6, without the cone shaped wall member 16, the body 10 provides a stop 4 in the inner portion for engaging with and for supporting the tip 30 of the dart 3.

Accordingly, the dart board in accordance with the present invention includes at least one inclined aperture for receiving and for supporting a dart therein such that the dart may be stably and safely supported in place without additional package.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dart board comprising:

a dart board body including a front and lower portion having at least one aperture formed therein for stably receiving and supporting a dart therein, said aperture being inclined and defined by a cone shaped wall member, said cone shaped wall member including a free end portion of reduced diameter and having at least one slit formed therein so as to form at least two resilient blades for resiliently engaging with the dart and for stably retaining the dart in place.

2. A dart board according to claim 1, wherein said dart board body includes a drawer slidably engaged therein for receiving elements therein.

* * * * *